US009071010B2

(12) United States Patent
Cuseo

(10) Patent No.: US 9,071,010 B2
(45) Date of Patent: Jun. 30, 2015

(54) TIGHT BEND-RADIUS CABLE STRUCTURES AND METHODS FOR MAKING THE SAME

(71) Applicant: Apple Inc., Cupertino, CA (US)

(72) Inventor: James M. Cuseo, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 93 days.

(21) Appl. No.: 13/796,492

(22) Filed: Mar. 12, 2013

(65) Prior Publication Data

US 2014/0094053 A1 Apr. 3, 2014

Related U.S. Application Data

(60) Provisional application No. 61/708,021, filed on Sep. 30, 2012.

(51) Int. Cl.
*H01R 13/58* (2006.01)
*H01R 43/00* (2006.01)

(52) U.S. Cl.
CPC ..... *H01R 13/58* (2013.01); *H01R 43/00* (2013.01); *Y10T 29/49174* (2015.01); *Y10T 29/49176* (2015.01); *H01R 13/5833* (2013.01); *H01R 13/5845* (2013.01)

(58) Field of Classification Search
CPC ..... H01R 13/5833
USPC ..... 439/604, 606, 736, 456
See application file for complete search history.

(56) References Cited

U.S. PATENT DOCUMENTS

| | | | | | |
|---|---|---|---|---|---|
| 2,672,594 | A * | 3/1954 | Morton | 439/369 |
| 3,078,433 | A * | 2/1963 | Sheesley | 439/278 |
| 3,551,879 | A * | 12/1970 | Waller, Sr. | 439/369 |
| 3,904,265 | A * | 9/1975 | Hollyday et al. | 439/469 |
| 4,094,564 | A * | 6/1978 | Cacolici | 439/456 |
| 4,289,366 | A * | 9/1981 | Marks | 439/293 |
| 4,445,741 | A * | 5/1984 | Annoot | 439/290 |
| 4,615,577 | A * | 10/1986 | Anderson | 439/468 |
| 4,784,616 | A * | 11/1988 | Zimmermann | 439/568 |
| 5,074,808 | A * | 12/1991 | Beamenderfer et al. | 439/606 |
| 5,080,608 | A * | 1/1992 | Yarnton et al. | 439/457 |
| 5,080,612 | A * | 1/1992 | Salomon | 439/568 |
| 5,145,402 | A * | 9/1992 | Plyler et al. | 439/459 |
| 5,564,944 | A * | 10/1996 | Fukuda | 439/521 |
| 5,605,473 | A * | 2/1997 | Kishon | 439/502 |
| 5,897,392 | A * | 4/1999 | Takahashi et al. | 439/470 |
| 6,152,761 | A * | 11/2000 | Wellinsky et al. | 439/456 |
| 6,231,375 | B1 * | 5/2001 | Kashiyama | 439/456 |
| 6,302,728 | B1 * | 10/2001 | Conorich et al. | 439/501 |
| 6,340,321 | B2 * | 1/2002 | Sawayanagi | 439/877 |
| 6,371,808 | B2 * | 4/2002 | Sakaguchi | 439/604 |
| 6,457,988 | B1 * | 10/2002 | Andersen | 439/373 |
| 6,475,032 | B1 * | 11/2002 | Dvorak | 439/606 |
| 7,033,203 | B2 * | 4/2006 | Titchener | 439/369 |
| 7,198,516 | B1 * | 4/2007 | Kemelman et al. | 439/604 |
| 7,232,331 | B2 * | 6/2007 | Dennes et al. | 439/404 |

(Continued)

*Primary Examiner* — Neil Abrams
(74) *Attorney, Agent, or Firm* — Van Court & Aldridge LLP

(57) ABSTRACT

Tight bend-radius cable structures and methods for making the same are disclosed. Tight bend-radius cable structures can include a cable electrically and physically coupled to a connector. An inner strain-relief member can be coupled to the cable and the connector to provide protection and strain relief for connection between the connector and the cable. The cable can then be manipulated into a final configuration, and an outer strain-relief member can be coupled to the cable and connector to hold the cable in its final configuration.

24 Claims, 6 Drawing Sheets

(56) References Cited

U.S. PATENT DOCUMENTS

| | | | | |
|---|---|---|---|---|
| 7,503,799 | B2 * | 3/2009 | Keith et al. | 439/417 |
| 7,518,852 | B2 * | 4/2009 | Kondas | 361/622 |
| 7,585,182 | B2 * | 9/2009 | Asante et al. | 439/502 |
| 7,901,219 | B2 * | 3/2011 | Sakiyama et al. | 439/76.2 |
| 8,292,663 | B2 * | 10/2012 | Crooijmans et al. | 439/604 |
| 2001/0024904 | A1 * | 9/2001 | Fischer | 439/456 |
| 2012/0040542 | A1 * | 2/2012 | Cao et al. | 439/83 |

* cited by examiner

TIGHT BEND-RADIUS CABLE STRUCTURES AND METHODS FOR MAKING THE SAME

CROSS-REFERENCE TO RELATED APPLICATION

This application claims the benefit of U.S. Provisional Application No. 61/708,021, filed Sep. 30, 2012, the disclosure of which is incorporated by reference herein in its entirety.

BACKGROUND OF THE DISCLOSURE

Cables are commonly used with electronic devices such as computers, cellphones, and portable media devices for routing electrical signals between various components of an electrical system. Cable manufacturers have conventionally attached cables to connectors in an inline configuration, limiting the potential for compact packaging of components in the system. Connections between cables and connectors can be protected from the environment and wear and tear using strain relief members.

SUMMARY OF THE DISCLOSURE

Tight bend-radius cable structures as disclosed herein can include a cable electrically and physically coupled to a connector. An inner strain-relief member can be coupled to the cable and the connector to provide protection and strain relief for connection between the connector and the cable. The cable can then be manipulated into a final configuration, and an outer strain-relief member can be coupled to the cable and connector to hold the cable in its final configuration.

One or both of the inner and outer strain-relief members can be overmolded at the junction between the cable and the connector housing. Alternatively, at least one of the inner and outer strain-relief members can be secured in place by employing an adhesive or compressive stress between various components of the tight bend-radius cable structure.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION OF DISCLOSURE

The following disclosure describes various embodiments of tight bend-radius cable structures. Certain details are set forth in the following description and figures to provide a thorough understanding of various embodiments of the present technology. Moreover, various features, structures, and/or characteristics of the present technology can be combined in other suitable structures and environments. In other instances, well-known structures, materials, operations, and/or systems are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods, components, and so forth.

The accompanying figures depict several features of embodiments of the present technology and are not intended to be limiting of its scope. Many of the details, dimensions, angles, and other features shown in the figures are merely illustrative of particular embodiments of the disclosure. Accordingly, other embodiments can have other details, dimensions, angles, and/or features without departing from the spirit or scope of the present disclosure.

Tight bend-radius cable structures can advantageously promote compact packing configurations in electrical systems by reducing the space required to route cables in desired directions. For example, a cable can be routed in a direction up to 180° from the direction from which it exits the connector. As used herein, a "cable" can refer to a single wire or a group of individual wires that can be used for routing electrical signals.

Tight bend-radius cable structures may be created using a two-part overmold structure. The overmold structure can include an inner strain-relief member for protecting the coupling junction between a cable and a connector. An outer strain-relief member can encase and protect a tight bend in the cable after it exits the inner strain-relief member. As used herein, a "tight bend-radius" can refer to a bend radius in a cable between a point at which repeated manipulations can lead to damage to the cable and a point at which a single manipulation may fracture or otherwise physically damage the cable (i.e., a minimum bend radius). Typical cable structures as known in the prior art cannot normally be subjected to such bending because repeated manipulation of cables up to the minimum bend radius can lead to permanent and catastrophic failure of the cable. Moreover, typical prior art cable structures often include strain-relief members that can prevent cables from being manipulated into tight bend-radius configurations.

Figure 1:
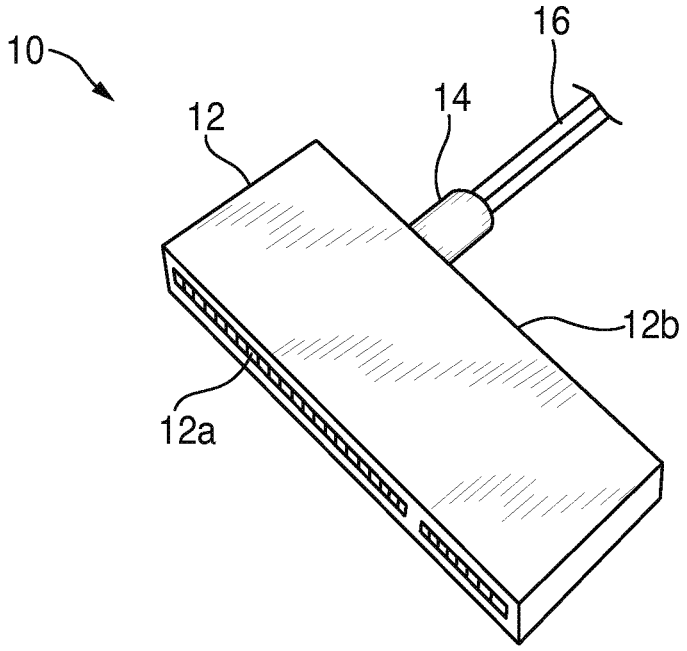
FIG. 1 Prior Art
FIG. 1 shows an illustrative perspective view of a prior art cable structure.

FIG. 1 shows an illustrative perspective view of a prior art cable structure 10. Prior art cable structure 10 can include a connector 12, a strain-relief member 14, and cable 16. Connector 12 includes a connector end 12*a* for coupling connector 12 to a corresponding receptacle and a cable end 12*b* for coupling connector 12 to cable 16. Cable 16 may be coupled to connector 12 at cable end 12*b* using any suitable process. For example, connector 12 may include a number of connector leads. Individual wires can be connected (e.g., soldered) to each connector lead and extend away from connector 12. As depicted, cable 16 exits cable end 12*b* of connector 12 in the direction extending perpendicularly from connector end 12*a* to cable end 12*b* without bending (i.e., at a 0° angle).

Strain-relief member 14 may protect the connection between a cable and a connector by providing stiff support for the cable close to the junction and allowing increasingly more flex along the length of the cable. However, because strain-relief member 14 reduces strain on cable 16 by increasing its bend radius and preventing harmful manipulation, it may not be possible to create tight bends close to connector 12. Additionally, creating a tight bend in cable 16 close to connector 12 without the benefit of strain-relief member 14 can result in early and catastrophic mechanical failure of prior art cable structure 10.

Figure 2:
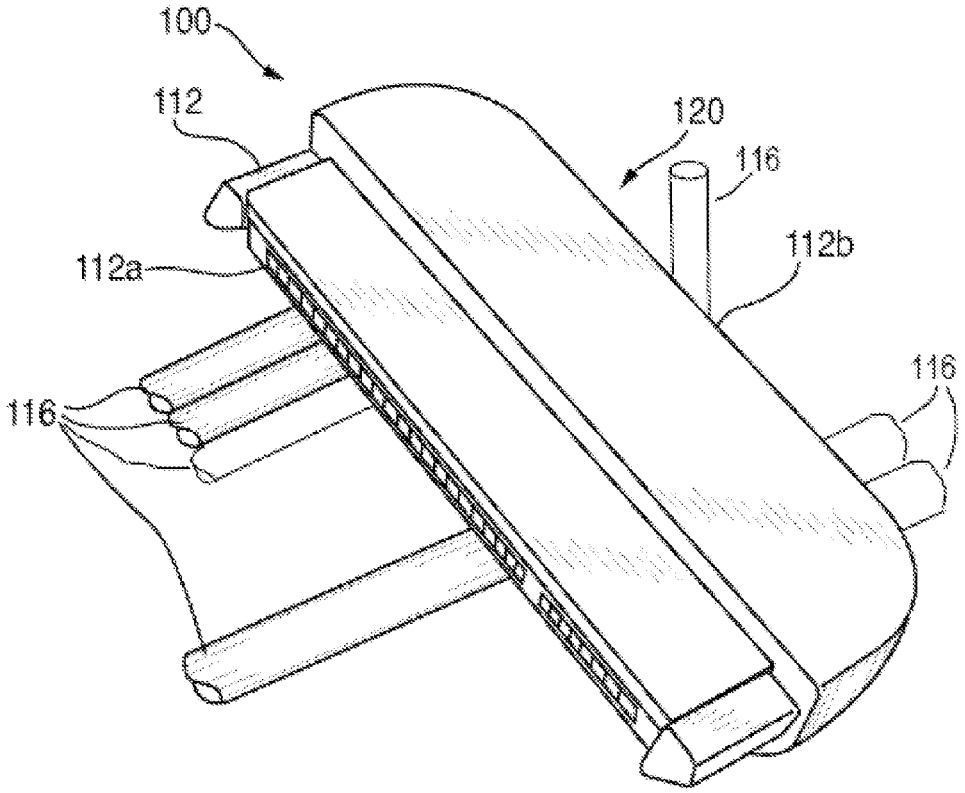
FIG. 2 shows an illustrative perspective view of a tight bend-radius cable structure in accordance with some embodiments of the disclosure.

FIG. 2 shows an illustrative perspective view of a cable structure 100 in accordance with some embodiments. Cable structure 100 can include a connector 112, a cable 116, and an overmold structure 120. In some embodiments, connector 112 can correspond to connector 12 of FIG. 1. Accordingly, connector 112 can include a connector end 112*a* for coupling connector 112 to a corresponding receptacle and a cable end 112*b* for coupling connector 112 to cable 116. Moreover, cable 116 can be coupled to connector 112 at cable end 112*b* using any suitable process (e.g., soldering individual wires of cable 116 to connector leads of connector 112).

However, unlike the prior art cable structure depicted in FIG. 1, cable 116 can include a tight-radius bend and exit connector end 112*a* of connector 112 (i.e., at a 180° angle). The tight-radius bend may be encased within overmold structure 120, which can be a two-part structure that protects the junction between connector 112 and cable 116 as well as the tight-radius bend that allows cable 116 to exit connector 112 at cable end 112*b*. As shown, cable 116 can include a number of individual wires or cables coupled to connector 112.

Figure 3:
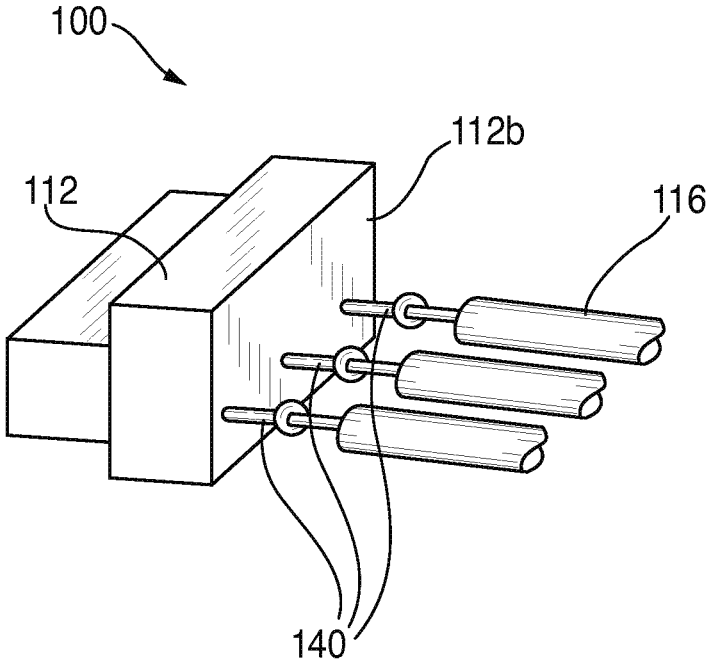
FIG. 3 shows an illustrative perspective view of a subassembly of a connector structure in accordance with some embodiments.

FIG. 3 shows an illustrative perspective view of a cable structure 100 in accordance with some embodiments of the present invention. Cable structure 100 can include a connector 112, connector leads 140, and cables 116. In some embodiments, connector 112 can correspond to connector 12 of FIG. 1 and/or connector 112 of FIG. 2. Connector 112 can include cable end 112*b* for connecting cable 116 to connector 112. Cable 116 can be connected to connector 112 using any suitable process. Connector leads 140 can facilitate the connection between cable 116 and connector 112 at cable end 112*b*. As seen in FIG. 3, connector leads 140 can extend out from cable end 112*b* of connector 112 and couple to one end of cable 116. Alternatively, connector leads can simply be any pins that protrude out to facilitate connection between connector 112 and cables 116. Connector leads can include, but are not limited to, connector leads for BNC cables, pigtail connectors, USB connectors, or any other connector lead known to those skilled in the art.

Figure 4A:
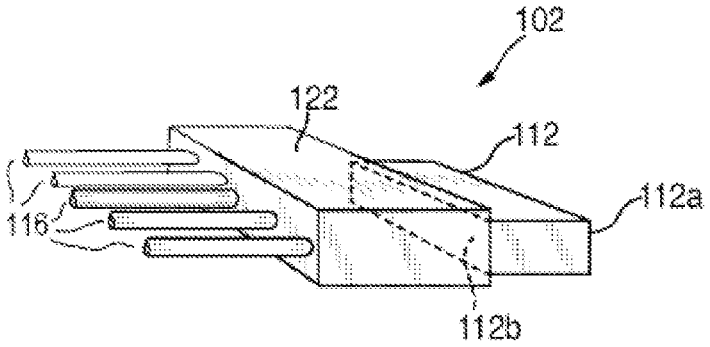
FIGS. 4A and 4B show illustrative perspective views of subassemblies of a tight bend-radius cable structure in accordance with some embodiments.
Figure 4B:
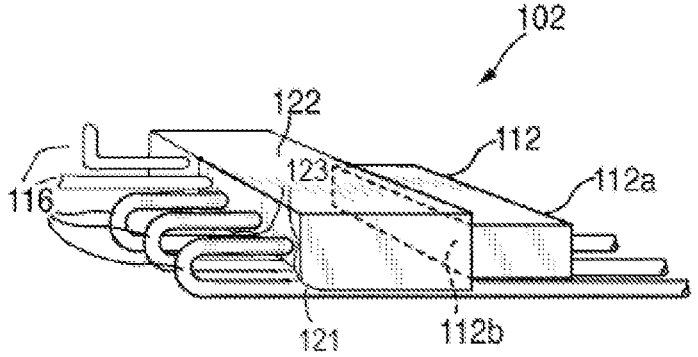

FIGS. 4A and 4B show illustrative perspective views of a subassembly 102 of a tight bend-radius cable structure subassembly in accordance with some embodiments. For example, cable subassembly 102 can be a subassembly of cable structure 100 of FIG. 2 and can include connector 112 coupled to cable 116 at cable end 112*b*. Inner strain-relief member 122 may be physically coupled to the junction formed at cable end 112*b* between connector 112 and cable 116 in order to protect the cable-connector connection. In some embodiments, inner strain-relief member 122 can cover at least part of connector 112 and/or cable 116.

Inner strain-relief member 122 can be formed using any suitable process. As one example, inner strain-relief member 122 can be formed in a molding process (e.g., a compression molding process or an injection molding process). After inner strain-relief member is molded it can be slid onto cable 116 and then coupled to the junction using, for example, thermal bonding and/or adhesive(s).

According to other embodiments, inner strain-relief member 122 can be overmolded over the junction as well as at least part of connector 112 and/or cable 116. The molding process may be, for example, an injection molding process in which cable structure 100 is inserted into a mold. A liquid material can be injected into the mold and allowed to harden around the portion of cable structure 100 encased within the mold (e.g., the junction between connector 112 and cable 116). The outer surfaces of the inner strain-relief member may be defined by the interior shape of the mold. Although inner strain-relief member 122 is depicted as having a block shape in FIGS. 4A and 4B, inner strain-relief member 122 can have any suitable shape (e.g., a cylindrical or oblate cylindrical shape). Inner strain-relief member 122 may be formed from any suitable material including silicone, thermoplastic elastomer ("TPE"), polyurethane, polyethylene terephthalate ("PET"), or any other suitable material or combination of materials.

After inner strain-relief member 122 is formed, cable 116 can be manipulated into a final desired configuration. In particular, cable 116 can be bent to extend in a direction different from the direction from which it exits connector 112. The region of cable 116 including this bend can be referred to as a "bend region." The region of cable 116 between connector 112 and the bend region may be referred to as a "coupling region."

Any suitable angle for the bend in the bend region may be chosen. For example, the bend angle may be based upon design constraints dictated by the space available in the electrical system of which subassembly 102 is a part. For example, as depicted in FIG. 4B, cable 116 can be bent 180° from the direction it exits connector 112 to extend towards connector end 112*a* of connector 112. Any other suitable bend angle (e.g., any angle between 0° and 180°) and direction (e.g., perpendicular or oblique to a top or bottom surface of connector 112) may be chosen to define the direction cable 116 extends after it exits the bend region. This region of cable 116 can be referred to as a "non-bend region."

In some embodiments, the cable can be bent to have a tight bend-radius to promote compact packing in an electrical system. The bend region may have a radius of curvature that places more strain upon cable 116 than would be acceptable in typical cable structures. For example, the radius of curvature may be equal to or less than a radius of curvature that would result in physical damage to the cable if repeated multiple times. In some embodiments, the radius of curvature of the bend region may be only slightly larger than the radius of curvature that would result in physical damage to cable 116 after being so manipulated only once.

According to some embodiments, inner strain-relief member 122 can be shaped to encourage cable 116 into a final desired configuration. For example, inner strain-relief member 122 can be molded to have a particular predetermined curvature that cable 116 can follow. Accordingly, instead of being shaped like a block as depicted in FIG. 4A, inner strain-relief member 122 can have, for example, a rounded, bullnose, or beveled edge profile 121 as depicted in FIG. 4B. In these embodiments, cable 116 can be manipulated to follow the edge profile of inner strain-relief member 122 in the bend region.

In further embodiments, inner strain-relief member 122 can include one or more features to encourage cable 116 into a desired final configuration. For example, inner strain-relief member 122 may include one or more fins, ridges, or passages that can serve to manipulate cable 116 in a certain direction, group together one or more individual wires of cable 116, or group together one or more additional cables coupled to connector 112.

Figure 5:
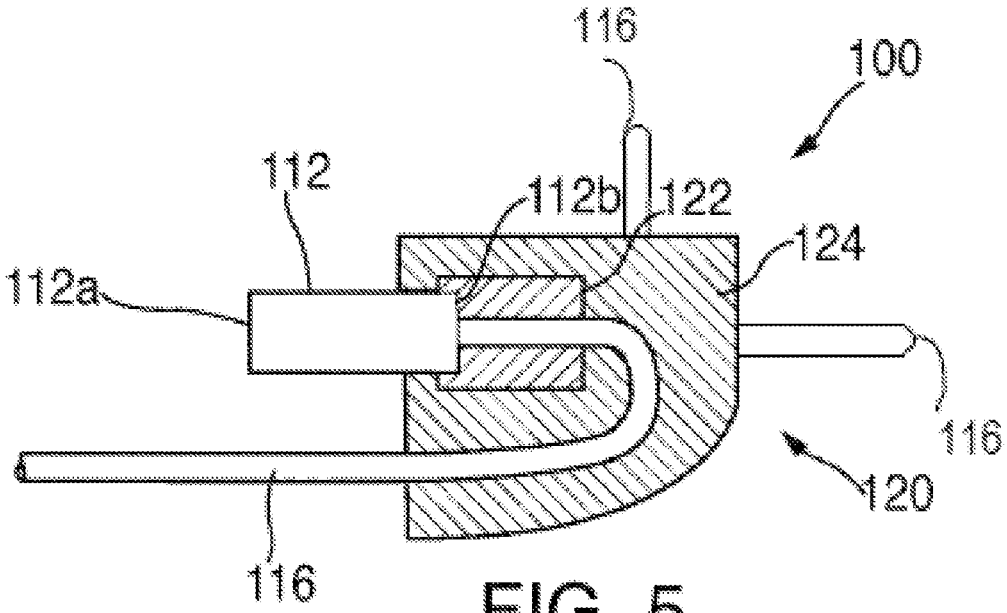
FIG. 5 shows a cross-sectional view of a tight bend-radius cable structure in accordance with some embodiments.

In still further embodiments, one or more additional cables 116 coupled to connector 112 may be bent in different directions from each cable 116 bent at 180° . For example, some cables 116 can be bent 180° (as depicted in FIGS. 4A and 4B), and other cables 116 (as depicted in FIGS. 4A and 4B and FIG. 5) can extend from connector 112 in any other suitable direction. In one particular embodiment, as depicted in FIGS.

4A and 4B and FIG. 5, one additional cable 116 can extend 0° from connector 112 and at least one other cable 116 can extend 90° from connector 112 and in a direction perpendicular to a top surface of connector 112. In some embodiments, the cables can be separated into any suitable number of groups (e.g., three or four) by one or more fins, ridges, or passages 123 included in inner strain-relief member 122.

FIG. 5 shows a cross-sectional view of a tight bend-radius cable structure 100 in accordance with some embodiments. Cable structure 100 can include connector 112 coupled to cable 116 at cable end 112*b*. Cable 116 may be bent 180° such that it extends from connector 112 towards connector end 112*a*. The bend in cable 116 can be encased by overmold structure 120, which can include inner strain-relief member 122 and outer strain-relief member 124. Cable structure 100 may correspond, for example, to subassembly 102 of FIG. 4B with the addition of outer strain-relief member 124.

Outer strain-relief member 124 can be physically coupled to subassembly 102 to encase inner strain-relief member 122, the bend created in cable 116, and/or at least a portion of connector 112. Outer strain-relief member 124 may be formed from any suitable material including silicone, thermoplastic elastomer ("TPE"), polyurethane, polyethylene terephthalate ("PET"), or any other suitable material or combination of materials. Furthermore, outer strain-relief member 124 can be formed from the same or a different material from inner strain-relief member 122.

However, because the outer surface of outer strain-relief member 124 may be visible to a user of cable structure 100, the material for outer strain-relief member 124 may be chosen for aesthetic considerations in addition to its usefulness as an enclosure material for the bend in cable 116. Contrariwise, because inner strain-relief member 122 may be fully encased within outer strain-relief member 124, its material may be chosen primarily for its ability to protect the cable/connector junction and provide strain relief for cable 116.

Outer strain-relief member 124 can be coupled to subassembly 102 using any suitable process. For example, outer strain-relief member 124 can be overmolded over subassembly 102. The molding process may be, for example, an injection molding process similar to the one used to create inner strain-relief member 122. Accordingly, a subassembly (e.g., subassembly 102 of FIG. 4B) including a connector and a cable with a coupling region, a bend region, and a non-bend region can be placed within a mold. A liquid material can be injected into the mold and allowed to harden around the portion of the subassembly encased within the mold (e.g., part of connector 112, as well as the coupling region, the bend region, and a portion of the non-bend region of cable 116). The outer surfaces of the outer strain-relief member may be defined by the interior shape of the mold. Accordingly, outer strain-relief member 124 can have any suitable shape (e.g., a cylindrical or oblate cylindrical shape). In some embodiments, the shape of outer strain-relief member 124 may be chosen or dictated based upon design constraints of the electrical system of which cable structure 100 is a part.

In other embodiments, outer strain-relief member 124 can be formed in a separate molding process (e.g., a compression molding process or an injection molding process) and then coupled to the junction using, for example, thermal bonding and/or adhesive(s).

Figure 6:
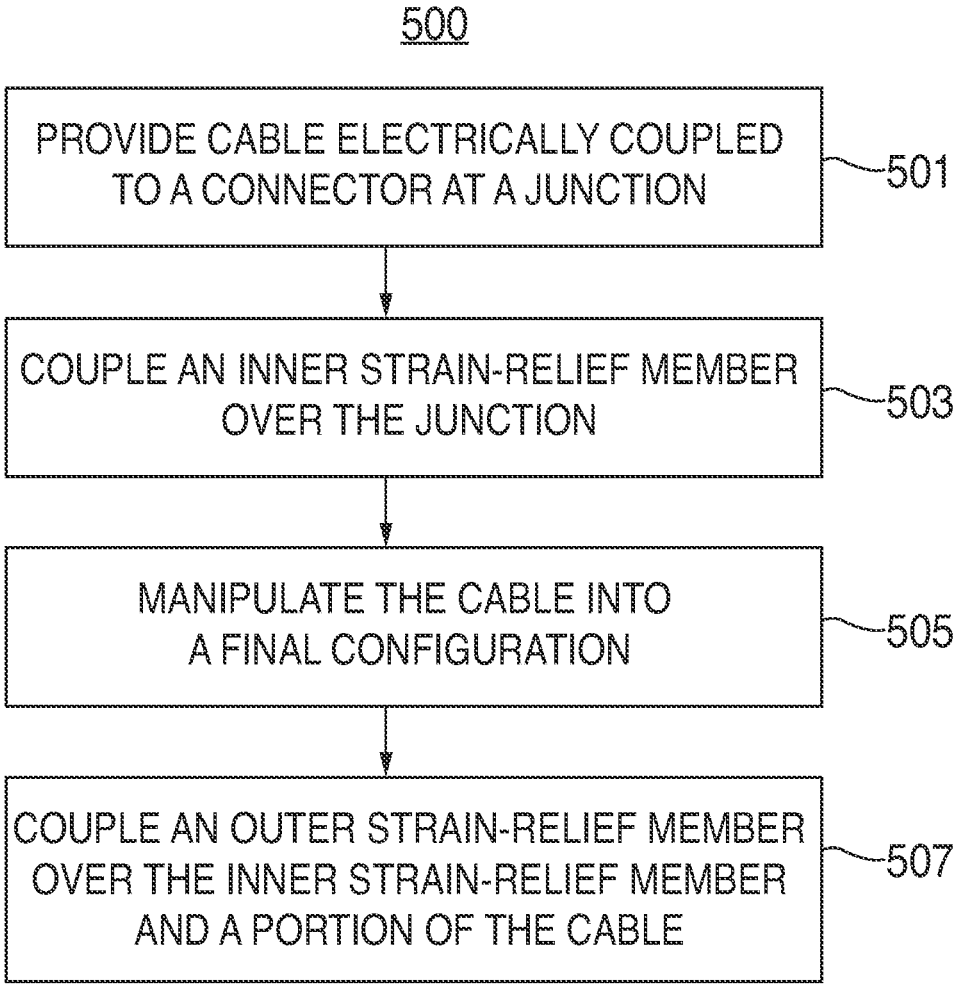
FIG. 6 is a flowchart of an illustrative process for forming a tight bend-radius cable structure in accordance with some embodiments.

FIG. 6 is a flowchart of an illustrative process 500 for forming a cable structure in accordance with some embodiments. At step 501, a cable can be provided that is electrically coupled to a connector. For example, cable 116 can be coupled to connector 112 of FIG. 2. Electrical coupling between the cable and connector can include, for example, solder connections between individual wires in the cable and electrically conductive contacts on the connector.

At step 503, an inner strain-relief member (e.g., inner strain-relief member 122 of FIG. 4A) can be coupled over the junction. For example, a mold for creating an inner strain-relief member over the junction between the connector and the cable can be provided. In some embodiments, the connector and the cable can be placed into the mold, and the inner strain-relief member may be molded directly over the junction using, for example, an overmold injection molding process. Alternatively, the inner strain-relief member may be formed in a separate mold and then coupled to the junction. In these latter embodiments, the inner strain-relief member may be formed with a cable passage that allows the cable to pass through the inner strain-relief member. The inner strain-relief member may then be physically coupled to the junction (e.g., using thermal bonding or an adhesive).

At step 505, the cable can be manipulated into a final configuration. For example, the cable can be bent at any angle up to 180° (e.g., towards connecter end 112*a* of connector 112). By virtue of the inner strain-relief member protecting the junction between the cable and the connector, the cable can be manipulated to form a tight bend radius, which can promote compact packaging of the cable structure within an electrical system. According to various embodiments, the cable may be manipulated by hand or by machine. The cable may also be bent to fit within a mold (e.g., a mold for forming an outer strain-relief member).

At step 507, an outer strain-relief member (e.g., outer strain-relief member 124 of FIG. 5) can be coupled over the inner strain-relief member and a portion of the cable. For example, the outer strain-relief member may fully encase the inner strain-relief member and a bend region of the cable that includes the bend formed in step 505. By encasing the bend region of the cable, the outer strain-relief member can hold the cable in its final configuration, prevent mechanical failure of the cable by preventing further bending of the cable within the cable structure, provide an aesthetically pleasing outer appearance for the cable structure, and provide strain relief to the cable as it exits the outer strain-relief member.

The outer strain-relief member may be formed in a process similar to the process that forms the inner strain-relief member. That is, the outer strain-relief member may be overmolded over the inner strain-relief member and at least the bend of the cable. The outer strain-relief member may also encase at least a portion of the connector, a coupling and bend region of the cable, and a length of the cable extending past the bend (e.g., a non-bend region). In other embodiments, the outer strain-relief member can be formed separately (e.g., injection molded) and then physically coupled to the rest of the cable structure using, for example, an adhesive.

It should be understood that the process described above is merely illustrative. Any of the steps may be removed, modified, or combined, and any additional steps may be added or steps may be performed in different orders, without departing from the scope of the invention.

The described embodiments of the invention are presented for the purpose of illustration and not of limitation.

What is claimed is:

1. A connector assembly comprising:

a connector comprising a connector housing and a plurality of cable connector leads, each connector lead extending out from the connector housing in a first direction;

at least one cable coupled to one of the connector leads, each cable comprising a coupling region, a bend region, and a non-bend region, wherein the coupling region extends in the first direction;

an inner strain-relief member that encapsulates the connector leads, at least a first portion of the connector housing, and at least a portion of the coupling region of each cable; and an outer strain-relief member that encapsulates the inner strain-relief member, at least a second portion of the connector housing, the bend region of each cable, and a portion of the non-bend region of each cable, the outer strain-relief member operative to secure the bend region of each cable in a curved position, and wherein the non-bend region of each cable extends in a second direction that is different than the first direction.

2. The connector assembly of claim 1, wherein the second direction is in an opposite direction of the first direction.

3. The connector assembly of claim 1, wherein the second direction ranges between about 90 and 180 degrees different than the first direction.

4. The connector assembly of claim 1, wherein the curved position has a predetermined radius.

5. The connector assembly of claim 1, wherein the inner strain-relief member and the outer strain-relief member have the same durometer value.

6. The connector assembly of claim 1, wherein the inner strain-relief member and the outer strain-relief member have different durometer values.

7. The connector assembly of claim 1, wherein the inner strain-relief member comprises at least one of silicone, a thermoplastic elastomer ("TPE"), a polyurethane, and polyethylene terephthalate ("PET").

8. The connector assembly of claim 1, wherein the outer strain-relief member comprises at least one of silicone, a thermoplastic elastomer ("TPE"), a polyurethane, and polyethylene terephthalate ("PET").

9. The connector assembly of claim 1, wherein the inner strain-relief member is contoured to selectively route the at least one cable.

10. The connector assembly of claim 9, wherein the inner strain-relief member is contoured to have one of a rounded, bullnose, and beveled edge profile to selectively route the at least one cable.

11. The connector assembly of claim 1, wherein:

the at least one cable comprises a plurality of cables; and the inner strain-relief member is contoured to at least one of separate different cables of the plurality of cables and group at least two of the plurality of cables.

12. The connector assembly of claim 1, wherein the second direction is 180 degrees different than the first direction such that at least a portion of the non-bend region of the at least one cable extends over the connector housing.

13. A method for making a connector assembly, the connector assembly comprising a connector comprising a connector housing and a plurality of leads extending out from the connector housing and at least one cable coupled to one of the leads, each of the at least one cable comprising a coupling region, a bend region, and a non-bend region, the method comprising:

encapsulating at least a portion of the coupling region of the cable, at least a first portion of the connector housing, and the plurality of leads with an inner strain-relief member;

manipulating the cable to create a tight-radius bend in the bend region; and coupling an outer strain-relief member over the inner strain-relief member, the bend region, at least a second portion of the connector housing, and at least a portion of the non-bend region of the cable.

14. The method of claim 13, wherein the encapsulating comprises injection molding the inner strain-relief member over the at least the portion of the coupling region of the cable and the plurality of leads as an overmold structure.

15. The method of claim 13, wherein the manipulating the cable comprises bending the cable as it exits the inner strain-relief member.

16. The method of claim 13, wherein the manipulating the cable comprises one of manually and mechanically bending the cable.

17. The method of claim 13, wherein the coupling the outer strain-relief member comprises injection molding the outer strain-relief member over the inner strain-relief member and the bend region of the cable as an overmold structure.

18. The method of claim 13, wherein the manipulating the cable comprises bending the cable in a direction opposing a direction from which the cable extends from the plurality of leads.

19. The method of claim 13, wherein the encapsulating the at least the portion of the coupling region of the cable and the plurality of leads with the inner strain-relief member comprises molding the inner strain-relief member and coupling the inner strain-relief member over the junction of the at least one cable and the one of the leads using an adhesive.

20. The method of claim 13, wherein the manipulating comprises bending the cable to create the tight-radius bend as a 180 degree bend in the bend region such that at least one portion of the non-bend region of the cable extends over the connector housing.

21. A connector assembly comprising:

a connector comprising a plurality of cable connector leads;

a plurality of individual cables each coupled to a respective one of the connector leads, each of the cables extending from the cable connector leads in a first direction, the plurality of cables comprising first and second sets, wherein each set comprises at least one cable of the plurality of cables, wherein each cable in the first set comprises a coupling region, a bend region, and a non-bend region, and wherein the coupling region extends in the first direction;

an inner strain-relief member that encapsulates the connector leads and the coupling region of each cable in the first set; and an outer strain-relief member that encapsulates the inner strain-relief member, the bend region of each cable in the first set, and a portion of the non-bend region of each cable in the first set, the outer strain-relief member operative to secure the bend region of each cable in the first set in a first curved position, and wherein:

the non-bend region of each cable in the first set extends in a second direction, the second direction being different than the first direction;

each cable in the second set comprises a coupling region, a bend region, and a non-bend region;

the inner strain-relief member encapsulates the connector leads and the coupling region of each cable in the first and second sets;

the outer strain-relief member encapsulates the inner strain-relief member and a portion of the non-bend region of each cable in the first and second sets;

the outer strain-relief member is operative to secure the bend region of each cable in the second set in a second curved position; and the non-bend region of each cable in the second set extends in a third direction, the third direction being different than the second direction.

22. The connector assembly of claim 21, wherein the non-bend region of each cable in the second set extends in the first direction.

23. The connector assembly of claim 21, wherein:

the connector comprises a connector housing out from which the plurality of cable connector leads extend, the inner strain-relief member encapsulates the connector leads, at least a first portion of the connector housing, and the coupling region of each cable in the first and second sets, and the outer strain-relief member encapsulates the inner strain-relief member, at least a second portion of the connector housing, and a portion of the non-bend region of each cable in the first and second sets.

24. The connector assembly of claim 21, wherein the third direction is different than the first direction.

* * * * *